US007762063B2

(12) United States Patent
Diringer et al.

(10) Patent No.: US 7,762,063 B2
(45) Date of Patent: Jul. 27, 2010

(54) HOUSING FOR AN EXHAUST GAS PURIFICATION COMPONENT FOR FORMING A JOINED CONNECTION WITH AN EXHAUST LINE SECTION, EXHAUST SYSTEM HAVING THE HOUSING AND MOTOR VEHICLE HAVING THE EXHAUST SYSTEM

(75) Inventors: Joachim Diringer, Bonn (DE); Friedrich-Wilhelm Kaiser, Neunkirchen-Seelscheid (DE); Jörg Gutowski, Eisenach (DE); Christian Smatloch, Paderborn (DE); Christian Howe, Paderborn (DE); Elmar Grussmann, Altenbeken (DE)

(73) Assignees: Emitec Gesellschaft fuer Emissionstechnologie mbH, Lohmar (DE); Benteler Automobiltechnik GmbH, Paderborn (DE)

( * ) Notice: Subject to any disclaimer, the term of this patent is extended or adjusted under 35 U.S.C. 154(b) by 49 days.

(21) Appl. No.: 11/848,383

(22) Filed: Aug. 31, 2007

(65) Prior Publication Data

US 2008/0053079 A1 Mar. 6, 2008

(30) Foreign Application Priority Data

Sep. 4, 2006 (DE) ..... 10 2006 041 743

(51) Int. Cl.
*F01N 3/10* (2006.01)

(52) U.S. Cl. ..... 60/299; 60/272; 60/300; 60/322; 60/323; 138/155; 285/104; 285/363; 285/416; 422/168; 422/169; 422/170

(58) Field of Classification Search ..... 60/272, 60/299, 322, 323, 282, 300; 138/155; 285/104, 285/124.2, 363, 416; 422/168, 169, 170
See application file for complete search history.

(56) References Cited

U.S. PATENT DOCUMENTS

| | | | | |
|---|---|---|---|---|
| 6,729,354 | B2 * | 5/2004 | Ishizu et al. | 138/109 |
| 6,923,942 | B1 * | 8/2005 | Shirk et al. | 422/179 |
| 2004/0216452 | A1 * | 11/2004 | Nakagome | 60/299 |
| 2005/0241303 | A1 * | 11/2005 | Nording et al. | 60/323 |

FOREIGN PATENT DOCUMENTS

| | | | |
|---|---|---|---|
| DE | 102 23 838 | C1 | 10/2003 |
| DE | 601 03 053 | T2 | 9/2004 |
| DE | 103 31 693 | A1 | 2/2005 |
| EP | 1 289 706 | B1 | 3/2003 |
| EP | 1367234 | A1 * | 12/2003 |
| EP | 1 498 586 | A1 | 1/2005 |

* cited by examiner

*Primary Examiner*—Binh Q. Tran
(74) *Attorney, Agent, or Firm*—Laurence A. Greenberg; Werner H. Stemer; Ralph E. Locher

(57) ABSTRACT

A housing for an exhaust gas purification component encloses an interior space in which at least one receptacle is formed by the housing at the outside. An exhaust system includes at least one first exhaust line section and the housing having the exhaust gas purification component. The first exhaust line section is in engagement with the receptacle, and the first exhaust line section and the receptacle are connected to one another in a materially integral manner. A motor vehicle having the exhaust system is also provided.

12 Claims, 2 Drawing Sheets

HOUSING FOR AN EXHAUST GAS PURIFICATION COMPONENT FOR FORMING A JOINED CONNECTION WITH AN EXHAUST LINE SECTION, EXHAUST SYSTEM HAVING THE HOUSING AND MOTOR VEHICLE HAVING THE EXHAUST SYSTEM

CROSS-REFERENCE TO RELATED APPLICATION

This application claims the priority, under 35 U.S.C. §119, of German Patent Application DE 10 2006 041 743.7, filed Sep. 4, 2006; the prior application is herewith incorporated by reference in its entirety.

BACKGROUND OF THE INVENTION

Field of the Invention

The present invention relates to a housing for an exhaust gas purification component for forming a joined connection with an exhaust line section. The housing encloses an interior space. Such housings having exhaust gas purification components are used in particular in the exhaust gas aftertreatment of mobile internal combustion engines. The invention also relates to an exhaust system having the housing and a motor vehicle having the exhaust system.

Several joining methods have already been described with regard to the integration of exhaust gas purification components into exhaust systems. In those methods, it is seen that, in the case of conventional exhaust gas purification components, where possible, the housing has a relatively thick-walled construction in order to permit welding of the housing to the exhaust line. In addition, housings are known which have a housing section that is bent at right angles in the manner of a collar which is positioned between two exhaust line sections and is connected thereto by technical joining. The known constructions have been widely proven, but cannot be used in particular applications. The preferred manner of producing the technical joining connection is by brazing. However, a sintering process or even welding may be used as well.

The integration or the fastening of the housing into an exhaust line is a problem in particular when the housing has a relatively thin-walled construction. That applies, for example, to housings which have a housing thickness of at most 1.5 mm or even less than 0.8 mm. With such thin-walled housings, it is not practically possible to produce simple welded connections which can durably withstand the aggressive ambient conditions in the exhaust system of a motor vehicle. The high thermal and dynamic loadings which occur there would result, after a short time, in failure of the simple welded connections between the housing and the exhaust line.

SUMMARY OF THE INVENTION

It is accordingly an object of the invention to provide a housing for an exhaust gas purification component for forming a joined connection with an exhaust line section, an exhaust system having the housing and a motor vehicle having the exhaust system, which at least partially overcome the hereinafore-mentioned disadvantages of the heretofore-known devices of this general type. In particular, a joined connection for thin-walled, reduced-weight housings or exhaust gas purification components should be specified, through the use of which a durable welded connection to the exhaust line can be realized. In this case, in particular, the installation of exhaust gas purification components into exhaust systems of motor vehicles should also be permitted in a cost-effective manner even under series production conditions.

With the foregoing and other objects in view there is provided, in accordance with the invention, a housing for an exhaust gas purification component. The housing comprises an interior space enclosed by the housing, an outside of the housing, and at least one receptacle formed by the outside of the housing.

The fact that the receptacle is formed by the housing itself means in particular that the receptacle is connected to the housing in one piece or constitutes a part of the housing itself (for example, is also made from the same material). For this purpose, the shape of the, for example, tubular housing is changed so as to form the receptacle. A receptacle which runs substantially around the housing at the outside is preferably formed. In this case, the receptacle can preferably be formed through the use of a part of the housing which runs around at the outside, though it is also possible for a plurality of housing sections (for example in the manner of a multiple-slotted collar), to form the receptacle.

In accordance with another feature of the invention, the at least one receptacle is preferably provided close to one end side of the housing. Even though it is fundamentally possible to provide a corresponding, if appropriate differently-constructed receptacle at both end sides, a housing with a receptacle at only one side is preferred.

In accordance with a further feature of the invention, an embodiment variant is preferred in which the at least one receptacle is formed by a part of the housing which is spaced apart parallel to another region of the housing. That is to say, in other words, in particular that the part of the housing and the region of the housing are aligned substantially coaxially with respect to one another. This can, for example, be obtained by shaping or bending a part of the housing close to the end side. In this case, the part of the housing is bent so far around as to be disposed approximately parallel to the region which holds the exhaust gas purification component.

In accordance with an added feature of the invention, with regard to the preferred application of a housing of this type, the following embodiment of the housing is considered to be advantageous: the housing has a housing thickness in a range of from 0.4 to 1.0 mm and the receptacle is formed by bending a part of the housing, with a bend radius being in a range of from 3 to 8 mm, and the receptacle having a length of at least 7 mm. In this case, the housing can be formed, in particular, with a housing thickness of less than 0.6 mm. The bending radius is then preferably in the region of 5 mm. The length of the receptacle proposed herein of at least 7 mm serves to ensure stable contact of the housing on the exhaust line section, which is to be mounted, during assembly. It is therefore then possible to permit a durable fixing of the housing to the exhaust line section, which results in particular from the fact that the part of the housing which should now be welded can be positioned outside the exhaust line section, and therefore the connecting region is no longer exposed to the aggressive media in the interior of the exhaust system.

With the objects of the invention in view, there is also provided an exhaust system, comprising a housing according to the invention for an exhaust gas purification component, and at least one first exhaust line section. The at least one first exhaust line section is in engagement with the receptacle, and the at least one first exhaust line section and the receptacle are connected to one another in a materially integral manner.

An embodiment which is very particularly preferable herein is that in which the first exhaust line section is positioned within the receptacle and outside the interior space of the housing, with approximately one engagement which surrounds the housing being formed. In this case, at least a part of the exhaust line section extends into the receptacle, so that the end of the exhaust line section is in particular surrounded by the housing.

In accordance with another feature of the invention, it is advantageous if at least one second exhaust line section is positioned on that side of the receptacle which is situated opposite the first exhaust line section, and the second exhaust line section is connected to the receptacle in a materially integral manner. There is therefore a sandwich-like configuration of the exhaust line sections with the part of the housing situated in between. This in particular creates the possibility of providing a sufficient material thickness in the region of the materially integral connection, and at the same time providing a very space-saving configuration for the technical joining connection.

In accordance with a further feature of the invention, the exhaust system can be welded effectively when, in the region of the materially integral connection through the use of the at least one exhaust line section and through the use of that part of the housing which forms the receptacle, a material thickness of at least 2.5 mm is provided. Particularly preferably proposed is a material thickness of at least 3 mm to 3.5 mm. In this case, with regard to the parts which are to be connected to one another, it is possible to assume a housing thickness in the range of from 0.4 to 0.6 mm and a line thickness of the exhaust line sections in the range of from 0.5 to 2.0 mm wherein this, is of course, not imperative.

In accordance with an added feature of the invention, the materially integral connection is realized through the use of a continuous weld seam. In this case, the weld seam in particular surrounds the periphery of the housing. The weld seam and periphery can, if appropriate, also be constructed to overlap.

The durability of the materially integral connection can, in particular, be improved through the use of the corresponding configuration of the retainer or of the housing.

With the objects of the invention in view, there is furthermore provided a motor vehicle, comprising an internal combustion engine, and an exhaust system for conducting an exhaust gas flow from the internal combustion engine, in a flow direction, through the exhaust system. The exhaust system includes a housing according to the invention for an exhaust gas purification component. The housing has the receptacle at an end side, and the end side with the receptacle forms an inlet end side for exhaust gas. At least one first exhaust line section is in engagement with the receptacle, and the at least one first exhaust line section and the receptacle are connected to one another in a materially integral manner.

That is to say, in other words, in particular that the exhaust gas initially impinges on the end side or inlet end side of the housing or of the exhaust gas purification component at which the receptacle is formed. The embodiment of the receptacle at the rear side results in a protected position for the welded connection. In addition, as a result of the inflow of the exhaust gas, the housing is pressed against the first exhaust line section, so that in this case, a reliable bond between the exhaust system and the housing is ensured even at particularly high loadings.

In accordance with a concomitant feature of the invention, in this orientation of the exhaust system, the housing, in the region of an outlet end side, is held with a spacing from the at least one exhaust line section, with a fixing device being provided in the spacing. The fixing device serves in particular to align the housing region with respect to the exhaust line, with relative movements being permitted if appropriate in order to permit different thermal expansion behaviors of the housing and of the exhaust line section substantially without stresses. In addition, the fixing device embodied, for example, in the manner of a wire fabric or the like can fulfill further functions, and therefore the fixing device can, if appropriate, include a device for sealing and/or for catalytically converting the exhaust gas.

In this case, the joining of the housing to the exhaust system includes, in particular, the following method steps:

a) producing a housing having an exhaust gas purification component in the interior space and having at least one receptacle, b) positioning a first exhaust line section in the receptacle of the housing, c) positioning at least one further exhaust line section outside at the receptacle, and d) technical joining of the exhaust line sections to the receptacle through the use of welding.

With regard to step a), the production of a receptacle can take place with the following manufacturing steps:

flanging the end of the housing a stationary, product-specific tool, flanging the end of the housing a stationary mandrel or using a plurality of mandrels in stages, flanging the end of the housing a flexible tool such as, for example, a roller having a rolling or pressing deformation.

With regard to step d), the technical joining of the exhaust line sections to the receptacle through the use of welding can include the following manufacturing steps: positioning the parts to be joined in an adequate configuration, and welding using an arc welding process with or without filler material.

In the first step (for example relating initially only to the first exhaust line section with the housing, as shown in FIG. 1), resistance spot welding or roller seam welding can advantageously also be used. In this case, there should be a very low introduction of heat in order to avoid thermal expansions.

The joining of the second exhaust line section (see also FIG. 2) preferably takes place by using a fusion welding process, with it optionally being possible in this case for a third exhaust line section to also be involved. It is preferable in this case for the relatively thin housing to be disposed between the relatively thick-walled first and third exhaust line sections and to be locally fused during welding.

Other features which are considered as characteristic for the invention are set forth in the appended claims. It is pointed out that the features listed individually in the patent claims can be combined with one another an any desired technologically expedient way and disclose further embodiments of the invention. The individual features from the patent claims are explained and specified in more detail in the description, so as to indicate additional, particularly preferred embodiment variants.

Although the invention is illustrated and described herein as embodied in a housing for an exhaust gas purification component for forming a joined connection with an exhaust line section, an exhaust system having the housing and a motor vehicle having the exhaust system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
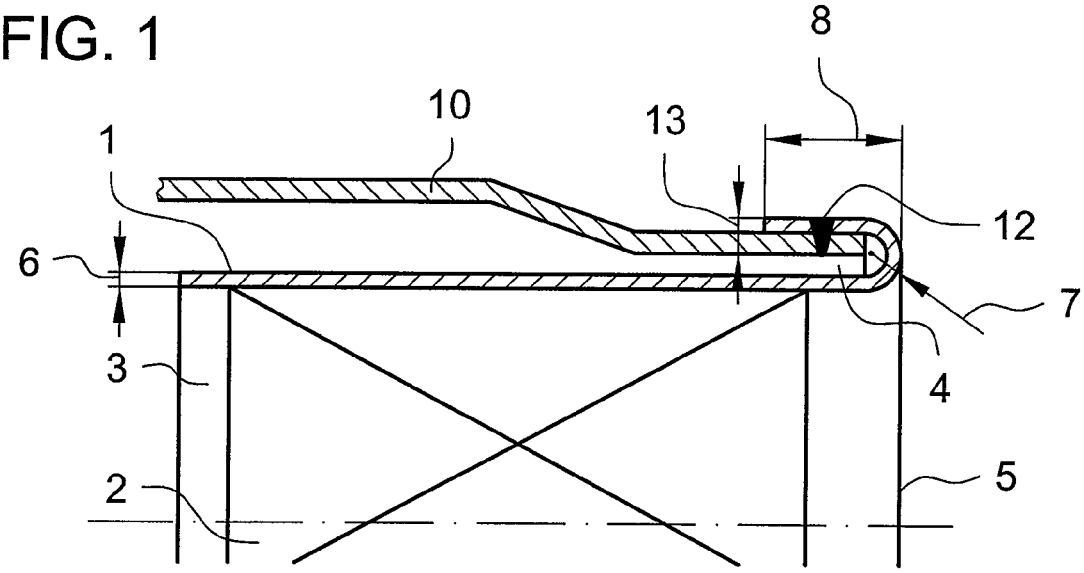
FIG. 1 is a fragmentary, diagrammatic, cross-sectional view of a first embodiment variant of a housing according to the invention.

Referring now to the figures of the drawings in detail and first, particularly, to FIG. 1 thereof, there is seen a diagrammatic and partial cross section of a housing 1 having a housing thickness 6 in the region of 0.5 mm. An exhaust gas purification component 2 is illustrated in an interior space 3 of the housing 1. The housing 1 has a receptacle 4, close to an end side 5, which is formed in such a way as to run around at the outside. The receptacle 4 has been generated by bending a part of the housing 1. In this case, a bend radius 7 in the region of 5 mm has been created. A rearward-bent part of the housing 1, which is formed substantially parallel to that region of the housing 1 which forms the interior space 3, has a length 8 of 7 to 10 mm.

A first exhaust line section 10, which is disposed in the receptacle 4, is placed in contact with the outer part of the housing 1 that forms the receptacle 4. A materially integral connection 12 is provided in the contact region which is preferably formed so as to run around the housing 1. A corresponding material thickness 13 is provided for the joining which is provided through the use of welding.

Figure 2:
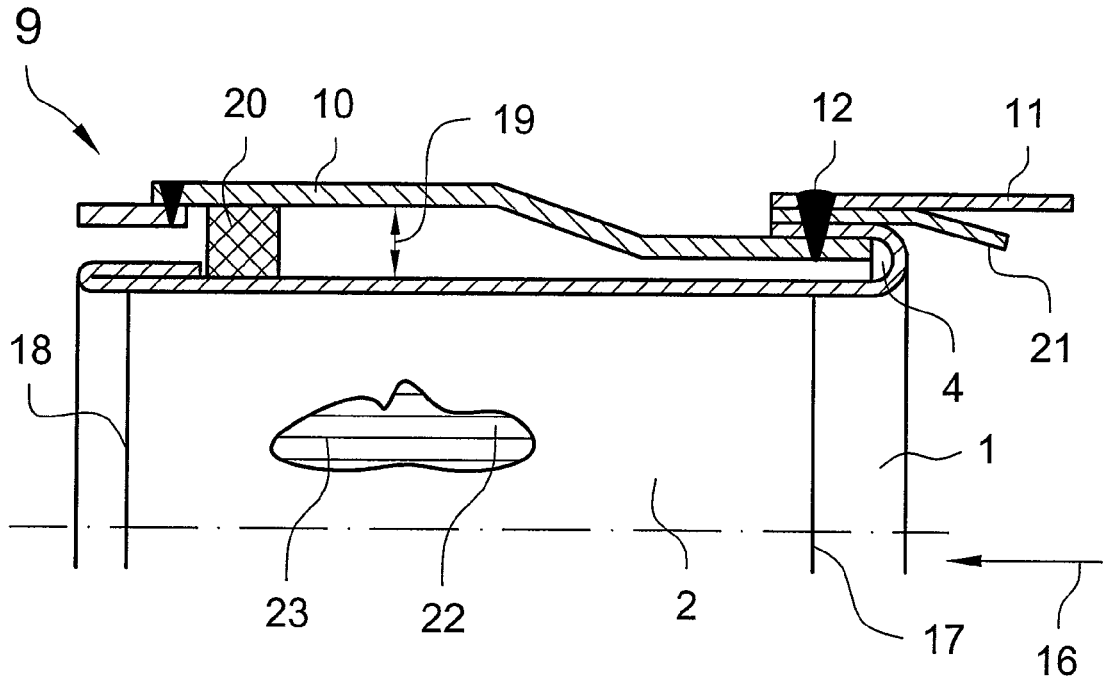
FIG. 2 is a partly broken-away cross-sectional view of a further embodiment variant of the housing according to the invention in an exhaust system.

A further embodiment variant for an exhaust system 9 of this type is shown in FIG. 2. In this case, it is again possible to see, in a partial cross section, the housing 1 which, in the interior, holds an exhaust gas purification component 2.

The exhaust gas purification component 2 is, for example, constructed in the manner of a honeycomb body from a plurality of metal foils or sheets 23 which form channels or passages 22 that can be traversed by the exhaust gas in a flow direction 16. The housing 1 or the exhaust gas purification component 2 has, after being aligned in the exhaust system 9, a defined inlet end side 17 and an outlet end side 18 relative to the flow direction 16. The housing 1 is disposed at a spacing 19 from the first exhaust line section 10 in the vicinity of the outlet end side 18. A fixing device 20 disposed in the spacing 19 holds the housing 1 at the spacing 19.

The receptacle 4 is again formed close to the inlet end side 17. In this embodiment variant, too, the first exhaust line section 10 is in engagement with the receptacle 4. In addition, further components of the exhaust line are positioned further out, outside the receptacle 4. Firstly, a third exhaust line section 21 (for example having a line thickness of approximately 0.5 mm) is placed in contact with the receptacle 4 at the outside. The third exhaust line section 21 can, for example, hold further exhaust gas purification components and/or permit a directed inflow of the exhaust gas into the exhaust gas purification component 2. In this embodiment variant, the outer closure is now formed by a second exhaust line section 11, so that the first exhaust line section 10 and the second exhaust line section 11 receive the third exhaust line section 21 and the receptacle 4 of the housing 1 in the manner of a sandwich. In the region of the materially integral connection 12, a material thickness is provided which is, for example, above 3 mm in this case and ensures a durable welded connection. This applies, in particular, with regard to the thin-walled or reduced-weight housing of the exhaust gas purification component used herein. The welded connection, which is referred to also as a so-called "tube canning", is advantageous specifically in the case of thin-walled housings.

Figure 3:
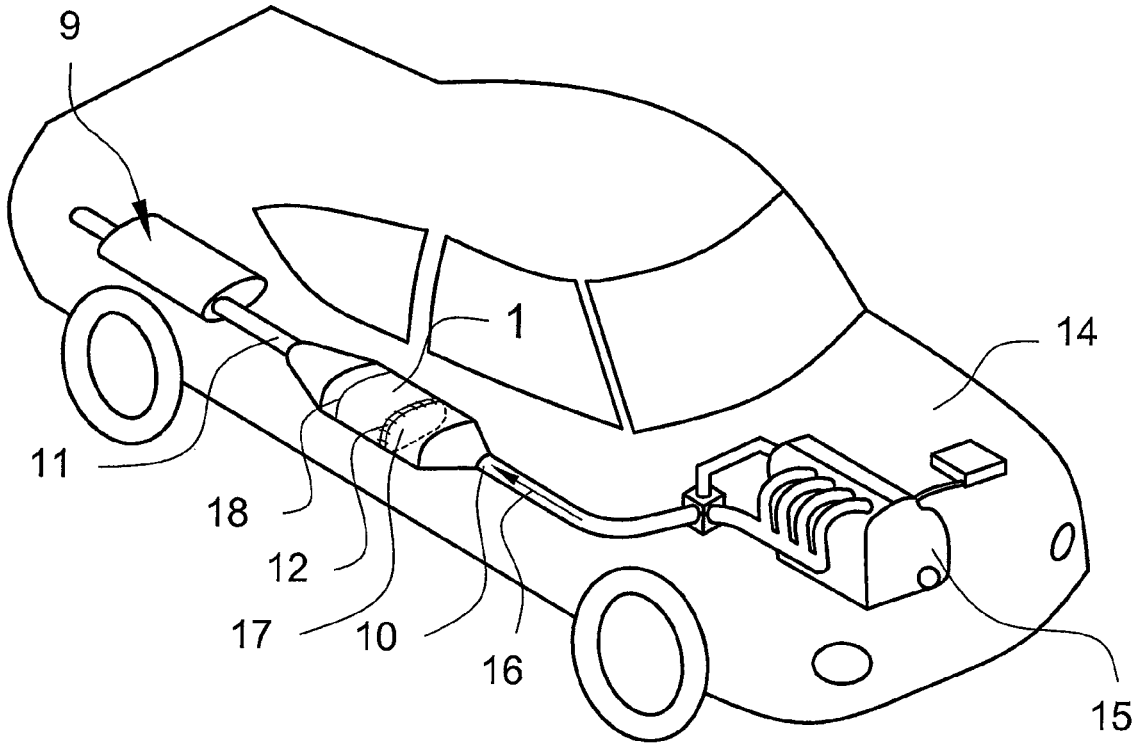
FIG. 3 is a perspective view of a motor vehicle showing the integration of the exhaust system therein.

FIG. 3 is provided to illustrate the integration of an exhaust system 9 of this type in a motor vehicle 14. The figure illustrates a motor vehicle 14 having an internal combustion engine 15. The exhaust gas which is generated in the internal combustion engine 15 flows in a flow direction 16 through the exhaust system 9. The exhaust gas is supplied to various exhaust gas purification components (such as catalytic converters, filters, absorbers and the like). The figure also illustrates the position of a materially integral connection 12 with regard to a first exhaust line section 10 and a second exhaust line section 11. The housing 1 at the same time is fixed in the materially integral connection 12, as explained above.

The invention claimed is:

1. An exhaust system, comprising:

a housing for an exhaust gas purification component, said housing having a housing thickness in a range of from 0.4 to 1.0 millimeters, said housing including:

an interior space enclosed by said housing;

an outside of said housing; and at least one receptacle formed by an outwardly bent part of said housing, said at least one receptacle having a bending radius in a range of from 3 to 8 millimeters; and at least one first exhaust line section engaging said receptacle;

said at least one first exhaust line section and said receptacle being connected to one another in a materially integral manner; and said outwardly bent part of said housing connected to said at least one first exhaust line section being positioned outside said at least one first exhaust line section.

2. The exhaust system according to claim 1, which further comprises an end side of said housing, said at least one receptacle being disposed close to said end side of said housing.

3. The exhaust system according to claim 1, wherein said at least one receptacle is formed by a part of said housing being spaced apart parallel to another region of said housing.

4. The exhaust system according to claim 1, wherein:

said receptacle has a length of at least 7 millimeters.

5. The exhaust system according to claim 1, wherein:

said receptacle has a side disposed opposite said at least one first exhaust line section;

at least one second exhaust line section is positioned at said side of said receptacle disposed opposite said at least one first exhaust line section; and said at least one second exhaust line section is connected to said receptacle in a materially integral manner.

6. The exhaust system according to claim 5, which further comprises a material thickness of at least 2.5 millimeters in a region of said materially integral connection of at least one of said exhaust line sections and a part of said housing forming said receptacle.

7. A motor vehicle, comprising:

an internal combustion engine; and an exhaust system according to claim 1 for conducting an exhaust gas flow from said internal combustion engine, in a flow direction, through said exhaust system, said housing of said exhaust system for an exhaust gas purification component having said receptacle at an end side, and said end side with said receptacle forming an inlet end side for exhaust gas.

8. The motor vehicle according to claim 7, wherein said housing has an outlet end side, said housing is disposed at a spacing from said at least one exhaust line section in vicinity of said outlet end side, and a fixing device is disposed in said spacing for holding said housing at said spacing.

9. The exhaust system according to claim 1, wherein said outwardly bent part of said housing forming said at least one receptacle is directly connected to said at least one first exhaust line section.

10. The exhaust system according to claim 1, wherein said first exhaust line section and said bent part of said housing connected to one another in said materially integral manner are not exposed to exhaust gas.

11. The exhaust system according to claim 1, wherein said first exhaust line section has a line thickness in a range of from 0.5 to 2.0 millimeters.

12. An exhaust system, comprising:

a housing for an exhaust gas purification component, said housing including:

an interior space enclosed by said housing;

an outside of said housing; and at least one receptacle formed by an outwardly bent part of said housing having a bending radius; and at least one first exhaust line section engaging in said receptacle, said at least one first exhaust line section having an inner surface, an outer surface and a thickness being less than said bending radius, causing said inner surface of said at least one first exhaust line section to be spaced apart from said housing in said receptacle;

said outer surface of said at least one first exhaust line section and said receptacle being connected to one another in a materially integral manner; and said outwardly bent part of said housing connected to said at least one first exhaust line section being positioned outside said at least one first exhaust line section.

* * * * *